US009326068B2

(12) United States Patent
Wu

(10) Patent No.: US 9,326,068 B2
(45) Date of Patent: Apr. 26, 2016

(54) SIGNAL CONNECTING MODULE, ELECTRONIC DEVICE, AND CONNECTOR IDENTIFICATION METHOD THEREOF

(75) Inventor: Tung-Ming Wu, New Taipei (TW)

(73) Assignee: Wistron Corporation, New Taipei (TW)

( * ) Notice: Subject to any disclaimer, the term of this patent is extended or adjusted under 35 U.S.C. 154(b) by 821 days.

(21) Appl. No.: 13/566,175

(22) Filed: Aug. 3, 2012

(65) Prior Publication Data

US 2013/0114824 A1 May 9, 2013

(30) Foreign Application Priority Data

Nov. 4, 2011 (TW) ..... 100140276 A

(51) Int. Cl.

*H04R 1/10* (2006.01)
*H04R 3/12* (2006.01)
*H04R 27/00* (2006.01)
(Continued)

(52) U.S. Cl.

CPC ..... *H04R 3/12* (2013.01); *H01R 13/641* (2013.01); *H01R 24/58* (2013.01); *H04R 27/00* (2013.01); *H04R 29/00* (2013.01); *H01R 2105/00* (2013.01); *H04R 1/1008* (2013.01); *H04R 1/403* (2013.01); *H04R 3/00* (2013.01); *H04R 2410/00* (2013.01)

(58) Field of Classification Search

CPC ..... H04R 3/00; H04R 27/00; H04R 3/12; H04R 1/1008; H04R 1/403; H04R 29/00; H04R 2410/00; H04R 24/58; H04R 2105/00; H04R 13/641
USPC ..... 381/74, 77
See application file for complete search history.

(56) References Cited

U.S. PATENT DOCUMENTS 8,497,603 B2 7/2013 Hsu et al.
2012/0200172 A1* 8/2012 Johnson ..... H04R 3/00 307/116

FOREIGN PATENT DOCUMENTS

CN 201142743 Y 10/2008
CN 101431708 A 5/2009
CN 102035911 A 4/2011
(Continued)

OTHER PUBLICATIONS

Office Action mailed Nov. 21, 2014 in corresponding CN Application No. 201110361182.1, and an English translation of pp. 3-10 thereof.

*Primary Examiner* — Paul S Kim
(74) *Attorney, Agent, or Firm* — Muncy, Geissler, Olds & Lowe, P.C.

(57) ABSTRACT

A signal connecting module, an electronic device, and a connector identification method thereof are disclosed. The signal connecting module is applied to the electronic device to electrically connect to the connector. The signal connecting module includes a connecting port, a controlling module, and a detecting module. The controlling module electrically connects to a first pin of the connecting port. When the connector connects to the connecting port, the controlling module outputs a detecting signal via the first pin to an earphone pin of the connector. The detecting module electrically connects to a second pin and a third pin of the connecting port; wherein after the controlling module outputs the detecting signal, the detecting module detects a current signal received by the second pin or the third pin to determine that the second pin or the third pin electrically connects to a ground pin of the connector.

13 Claims, 5 Drawing Sheets

(51) Int. Cl.

| | |
|---|---|
| ***H04R 29/00*** | (2006.01) |
| ***H01R 13/641*** | (2006.01) |
| ***H01R 24/58*** | (2011.01) |
| *H04R 1/40* | (2006.01) |
| *H04R 3/00* | (2006.01) |
| *H01R 105/00* | (2006.01) |

(56) References Cited

FOREIGN PATENT DOCUMENTS

| | | |
|---|---|---|
| TW | M242899 U | 9/2004 |
| TW | 201025742 A1 | 7/2010 |

* cited by examiner

SIGNAL CONNECTING MODULE, ELECTRONIC DEVICE, AND CONNECTOR IDENTIFICATION METHOD THEREOF

BACKGROUND OF THE INVENTION

1. Field of the Invention

The present invention relates to a signal connecting module, an electronic device, and a connector identification method thereof; more particularly, the present invention relates to a signal connecting module, an electronic device, and a connector identification method, which can detect the positions of different pins.

2. Description of the Related Art

As technology develops, many video or audio electronic devices are applied widely in variety of situation. In current audio and video products, an earphone usually uses the TRS (Tip, Ring, Sleeve) terminal as a connector. An audio and video device which combines a microphone and an earphone is disclosed, the device is also known as "earphone microphone". The connector of this kind of device includes the left and right channels of the earphone pin and the microphone pin.

But in the prior art, the pins of the earphone or the microphone made by different companies, may have different positions of the TRS terminal; each companies may define a connector with special spec to work with their own electronic device products. Take the products of Apple Inc.® for example, the position of the microphone pin of products of Apple Inc.® is different from the position of the microphone pin of the common earphone microphone, therefore, the common earphone microphone cannot be applied to products of Apple Inc.®, and the earphone microphone of Apple Inc.® cannot be applied to common electronic device. The products cannot work with each other, such that the customers have to pay additional and unnecessary cost to buy the exclusive products.

Therefore, there is a need to provide a signal connecting module, an electronic device, and a connector identification method thereof, for detecting and applied to the connectors with different specs.

SUMMARY OF THE INVENTION

It is an object of the present invention to provide a signal connecting module for detecting the position of different pin.

It is another object of the present invention to provide an electronic device with the signal connecting module thereof.

It is another object of the present invention to provide a connector identification method.

To achieve the abovementioned object, the signal connecting module of the present invention is applied to an electronic device for electrically connecting a connector. The connector comprises at least one earphone pin and a ground pin. The signal connecting module comprises a connecting port, a controlling module, and a detecting module. The connecting port is used for electrically connecting to the connector. The connecting port comprises a first pin, a second pin, and a third pin. The first pin is electrically connected to at least one earphone pin and an earphone signal end of the electronic device. The controlling module is electrically connected to the first pin. When the connector connects to the connecting port, the controlling module outputs a detecting signal via the first pin to an earphone pin of the connector. The detecting module is electrically connected to the second pin and the third pin, wherein after the controlling module outputs the detecting signal, the detecting module detects a current signal received by the second pin or the third pin to determine that the ground pin of the connector is electrically connected to the second pin or the third pin.

The electronic device of the present invention comprises an audio processing module and a signal connecting module. The audio processing module comprises an earphone signal end. The signal connecting module is electrically connected to the audio processing module for electrically connecting to the connector. The connector comprises at least one earphone pin and a ground pin. The signal connecting module comprises a connecting port, a controlling module, and a detecting module. The connecting port is used for electrically connecting to the connector. The connecting port comprises a first pin, a second pin, and a third pin. The first pin is electrically connected to the at least one earphone pin and the earphone signal end. The controlling module is electrically connected to the first pin; when the connecting port connects to the connector, the controlling module outputs a detecting signal to the earphone pin via the first pin. The detecting module is electrically connected to the second pin and the third pin, wherein after the controlling module outputs the detecting signal, the detecting module detects a current signal received by the second pin or the third pin to determine that the ground pin of the connector is electrically connected to the second pin or the third pin.

The connector identification method of the present invention comprises the steps of: providing a connecting port to electrically connect to the connector; importing a detecting signal to the at least one earphone pin via the first pin; and detecting a current signal received by the second pin or the third pin to determine that the ground pin of the connector is electrically connected to the second pin or the third pin.

DETAILED DESCRIPTION OF THE PREFERRED EMBODIMENTS

These and other objects and advantages of the present invention will become apparent from the following description of the accompanying drawings, which disclose several embodiments of the present invention. It is to be understood that the drawings are to be used for purposes of illustration only, and not as a definition of the invention.

Figure 1:
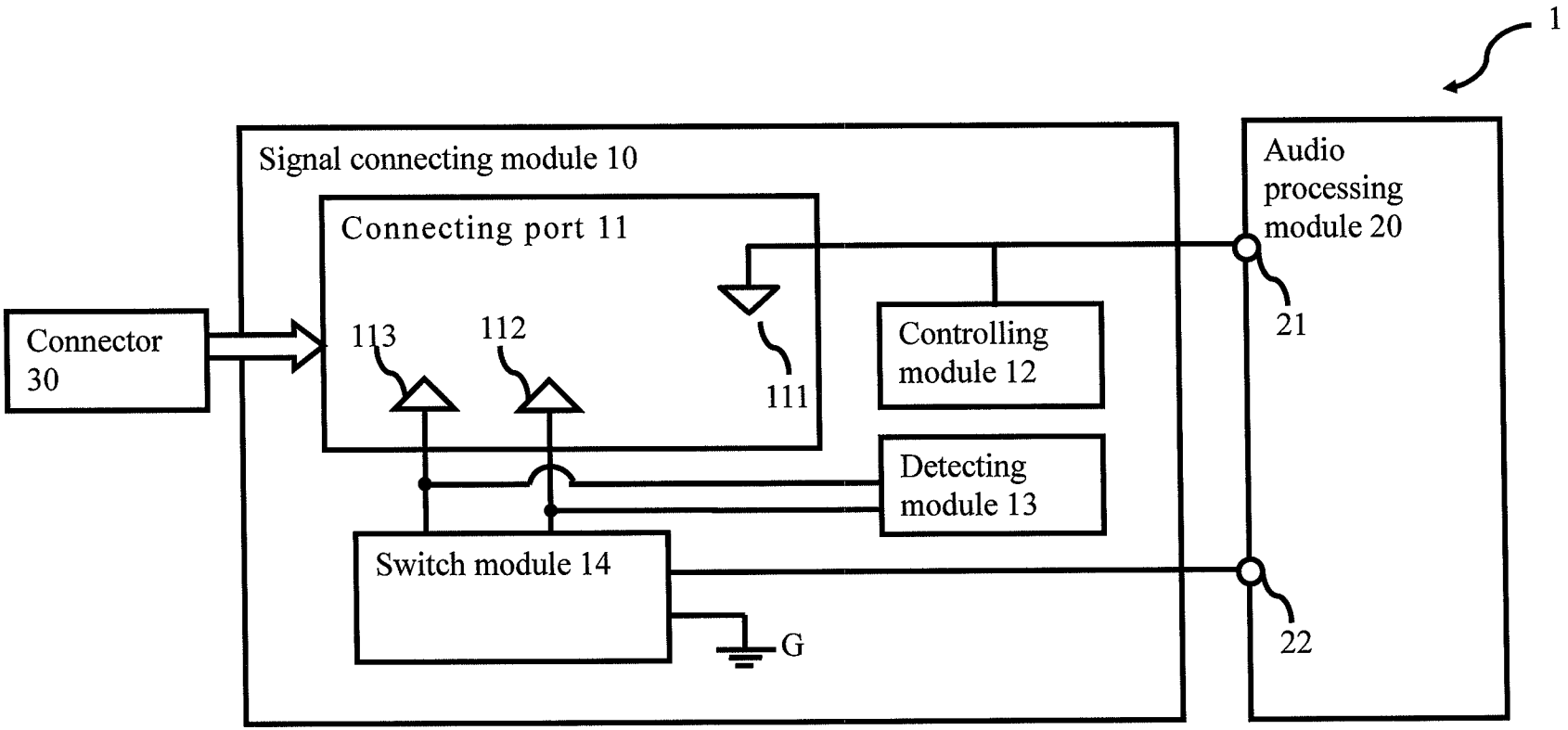
FIG. 1 illustrates a structure schematic drawing of an electronic device with a signal connecting module of the present invention.

Please refer to FIG. 1, which illustrates a structure schematic drawing of an electronic device with a signal connecting module of the present invention.

The electronic device 1 of the present invention can be a cell phone, a recording device, an audio device, a notebook, or a desk computer, but the present invention is not limited to those devices. The electronic device 1 can be electrically connected to the connector 30, wherein the connector 30 can be a TRS connector which can be applied to an earphone or a microphone device. The electronic device 1 receives or delivers the audio signal to the earphone or the microphone device via the connector 30. The electronic device 1 comprises a signal connecting module 10 and an audio processing module 20.

The signal connecting module 10 is used for connecting the connector 30. The signal connecting module 10 comprises a connecting port 11, a controlling module 12, a detecting module 13, and a switch module 14. The connecting port 11 is used for connecting to the connector 30, the controlling module 12 outputs the detecting signal to the connector 30 via the pin of the connecting port 11, then the detecting module 13 detects which pin delivers the current signal, to know the type of the connector 30. After the type of the connector 30 is known, the switch module 14 switches the connecting path of the pin to deliver the audio signal correctly.

The audio processing module 20 comprises an earphone signal end 21 and a microphone signal end 22. The earphone signal end 21 is electrically connected to the first pin 111 of the connecting port 11 for connecting to the connector 30 to deliver the audio signal. According to the type of the connector 30, the microphone signal end 22 is electrically connected to the second pin 112 or the third pin 113 for delivering the audio signal.

It is to be understood that the abovementioned controlling module 12, the detecting module 13, the switch module 14, and the audio processing module 20 can be several microcontrollers, or to be located in a same central processing unit (not shown), and to achieve the above-mentioned function via the central processing unit, but the present invention is not limited to those designs.

Figure 2:
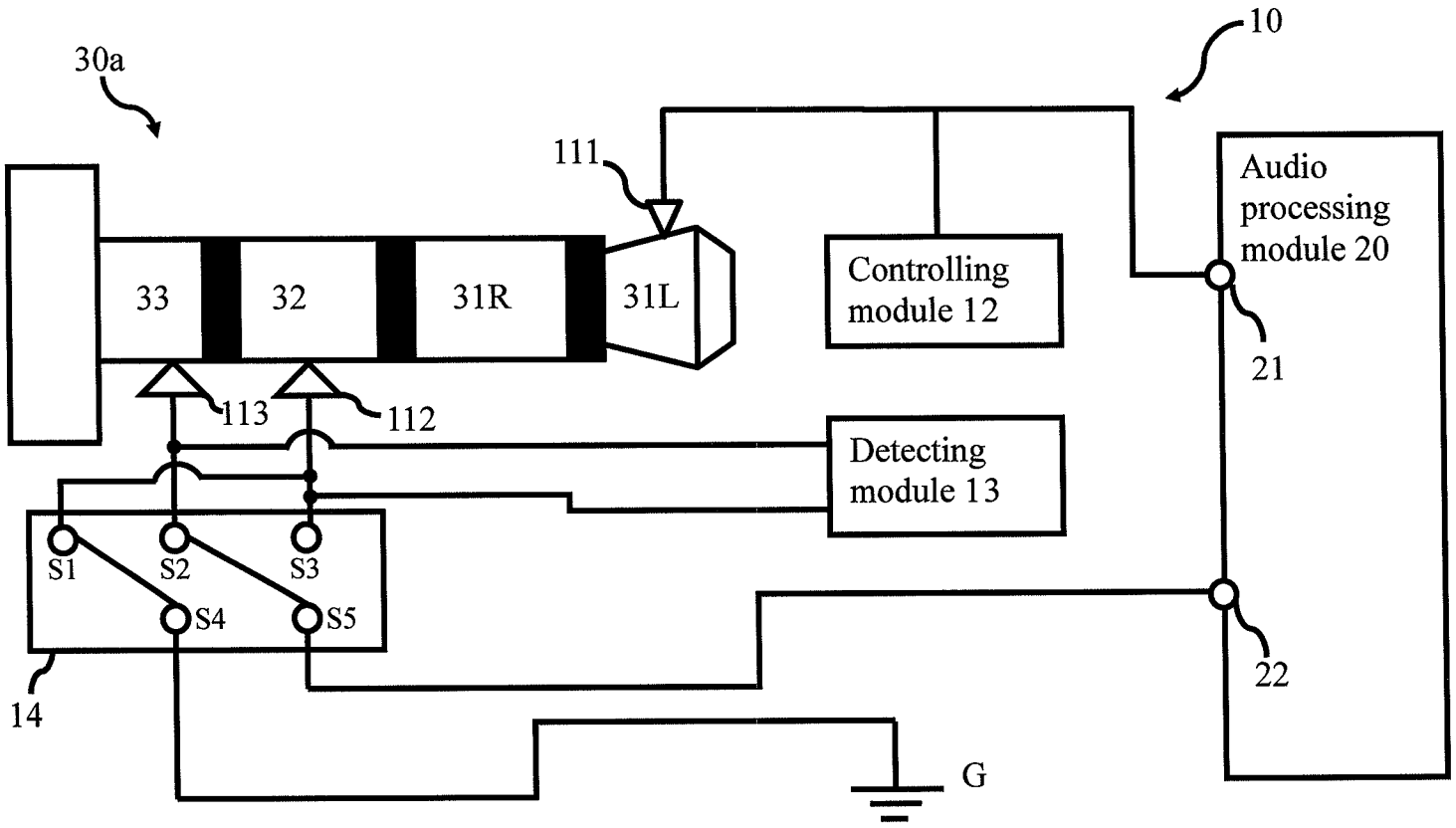
FIG. 2 illustrates a schematic drawing of a signal connecting module connected to a connector of the first embodiment of the present invention.

Please refer to FIG. 2 for the detail action of the signal connecting module 10. FIG. 2 illustrates a schematic drawing of a signal connecting module connected to a connector of the first embodiment of the present invention.

The connecting port 11 of the signal connecting module 10 is connected to the connector 30*a*, and comprising a plurality of pins to respectively electrically connect to the different pins of the connector 30*a*. In the first embodiment of the present invention, the connecting port 11 comprises the first pin 111, the second pin 112, and the third pin 113. The first pin 111 is connected to the earphone pin 31L of the connector 30*a*. The connector 30*a* can comprises two earphone pins 31L, 31R, which respectively represent the left channel and the right channel of the earphone. In the first embodiment, the first pin 111 is connected to the single earphone pin 31L of the connector 30*a*, but the first pin 111 can also be connected to the other earphone pin 31R for delivering the detecting signal. The second pin 112 and the third pin 113 of the connecting port 11 are respectively connected to the ground pin 32 of the connector 30*a* and the microphone pin 33.

It is to be understood that the number of the pins of the connecting port 11 of the present invention is not limited. The connecting port 11 can comprise another pin for connecting the earphone pin 31R, to deliver the audio signal of the right channel of the earphone. The delivering method of the audio signal is not the focus of improvements of the present invention, so there is no need to describe here.

The controlling module 12 can be formed by a hardware or a firmware combined with a hardware. In one embodiment of the present invention, the controlling module 12 is a microcontroller, but the present invention is not limited to that design. The controlling module 12 is electrically connected to the first pin 111 of the connecting port 11; when the controlling module 12 detects that the connector 30 plugs to the connecting port 11, the controlling module 12 is used for outputting the detecting signal of the voltage form or the current form to the first pin 111. The detecting method for detecting whether the connector 30 plugs to the connecting port 11 is already disclosed in the prior art, and the focus of improvement of the present invention is not to detect if the connector 30 plugs to the connecting port 11, so there is no need to describe here. The voltage value or current value of the detecting signal outputted by the controlling module 12 is defined according to the allowable value of the controlling module 12; the value is not limited in the present invention. The detecting signal is delivered to the earphone pin 31L of the connector 30*a* via the first pin 111.

The detecting module 13 can be formed by a hardware or a firmware combined with a hardware. In one embodiment of the present invention, the detecting module 13 and the controlling module 12 can be located in a same central processing unit or in different microcontrollers. The detecting module 13 can be formed by the bipolar junction transistor (BJT) or the metal-oxide-semiconductor field-effect transistor (MOSFET), but the present invention is not limited to that design. The detecting module 13 is electrically connected to the second pin 112 and the third pin 113 of the connecting port 11, for receiving the current signal delivered back by the connector 30*a*. According to the current existing technology, there must be a resistance value in the earphone to achieve the sounding function; the resistance value can be 16 or 32 ohm. Therefore, when the earphone pin 31 imports the detecting signal of the voltage form or the current form, the current signal is generated and delivered to the ground pin 32, such that the detecting module 13 can determine the type of the connector 30*a* according to the pin which detects the current signal.

In the first embodiment of the present invention, if the detecting module 13 receives the current signal via the second pin 112, it represents that the second pin 112 is connected to the ground pin 32, and the third pin 113 is connected to the microphone pin 33. In the first embodiment, the detecting module 13 determines that the connector 30*a* is the first type connector 30*a*, which means the sequence of the pin (from right to left) is the earphone pin 31, the ground pin 32, and the microphone pin 33.

The signal connecting module 10 can further comprise a switch module 14; according to the type of the connector 30*a*, the switch module 14 switches the second pin 112 and the third pin 113 to electrically connect to the grounding end G or the microphone signal end 21 of the electronic device 1. The switch module 14 can execute the switching function by the controlling module 12, the detecting module 13, or other controlling module; the controlling method of the present invention is not limited.

In the first embodiment of the present invention, the switch module 14 can be a general physical hardware switch, such as a double pole double throw switch, but the present invention is not limited to that design. The switch module 14 can also be a hardware of a microprocessor, or a software which is combined with a firmware, to achieve the switching function. The switch module 14 can comprise a first contact S1, a second contact S2, a third contact S3, a fourth contact S4, and a fifth contact S5. The first contact S1 is electrically connected to the third contact S3, and connected to the second pin 112; the second contact S2 is connected to the third pin 113; the fourth contact S4 is connected to the grounding end G; the fifth contact S5 is connected to the microphone signal end 22.

When the connecting port 11 is connected to the first type connector 30*a*, the switch module 14 switches the fourth contact S4 to connect to the first contact S1, and switches the fifth contact S5 to connect to the second contact S2, allowing the second pin 112 to be electrically connected to the grounding end G, and the third pin 113 to be electrically connected to the microphone signal end 22.

Via the microphone pin 33 of the connector 30*a* electrically connected to the third pin 113, the audio signal of the microphone is delivered to the microphone signal end 22, allowing the audio processing module 20 to do the following process. At this moment, the ground pin 32 is electrically connected to the grounding end G via the second pin 112.

Figure 3:
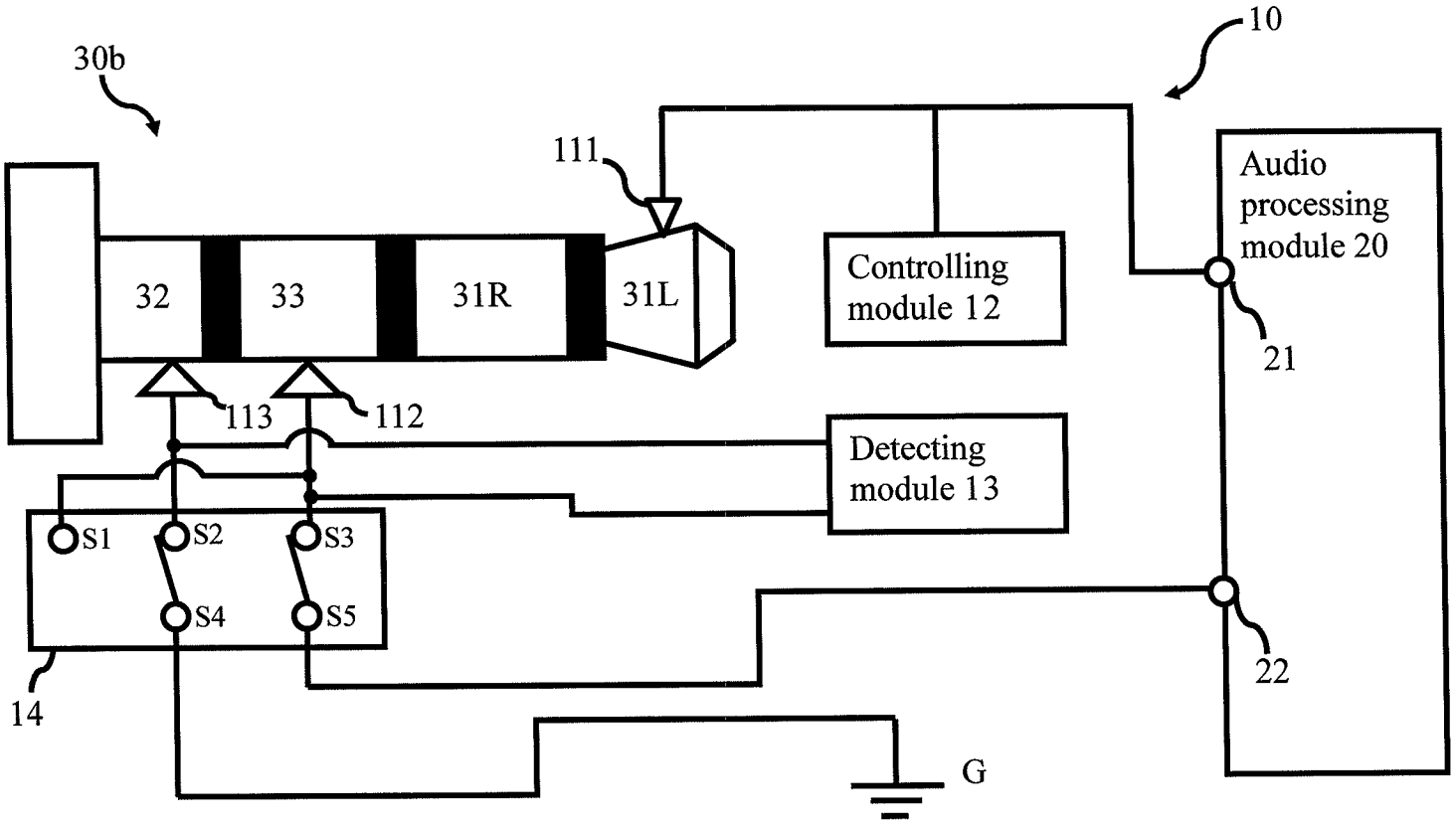
FIG. 3 illustrates a schematic drawing of a signal connecting module connected to a connector of the second embodiment of the present invention.

Please refer to FIG. 3, which illustrates a schematic drawing of a signal connecting module connected to a connector of the second embodiment of the present invention.

In the second embodiment of the present invention, after the controlling module 12 outputs the detecting signal, the detecting module 13 detects the current signal via the third pin 113; therefore, the third pin 113 is determined to be connected to the ground pin 32, such that the detecting module 13 detects that the connector 30*b* of the second embodiment is the second type connector 30*b*, which means the sequence of the pin (from right to left) is the earphone pin 31, the microphone pin 33, and the ground pin 32.

When the connecting port 11 connects to the second type connector 30*b*, the switch module 14 switches the fourth contact S4 to connect to the second contact S2, and switches the fifth contact S5 to connect to the third contact S3, allowing the third pin 113 to be electrically connected to the grounding end G, and the second pin 112 to be electrically connected to the microphone signal end 22.

Figure 4:
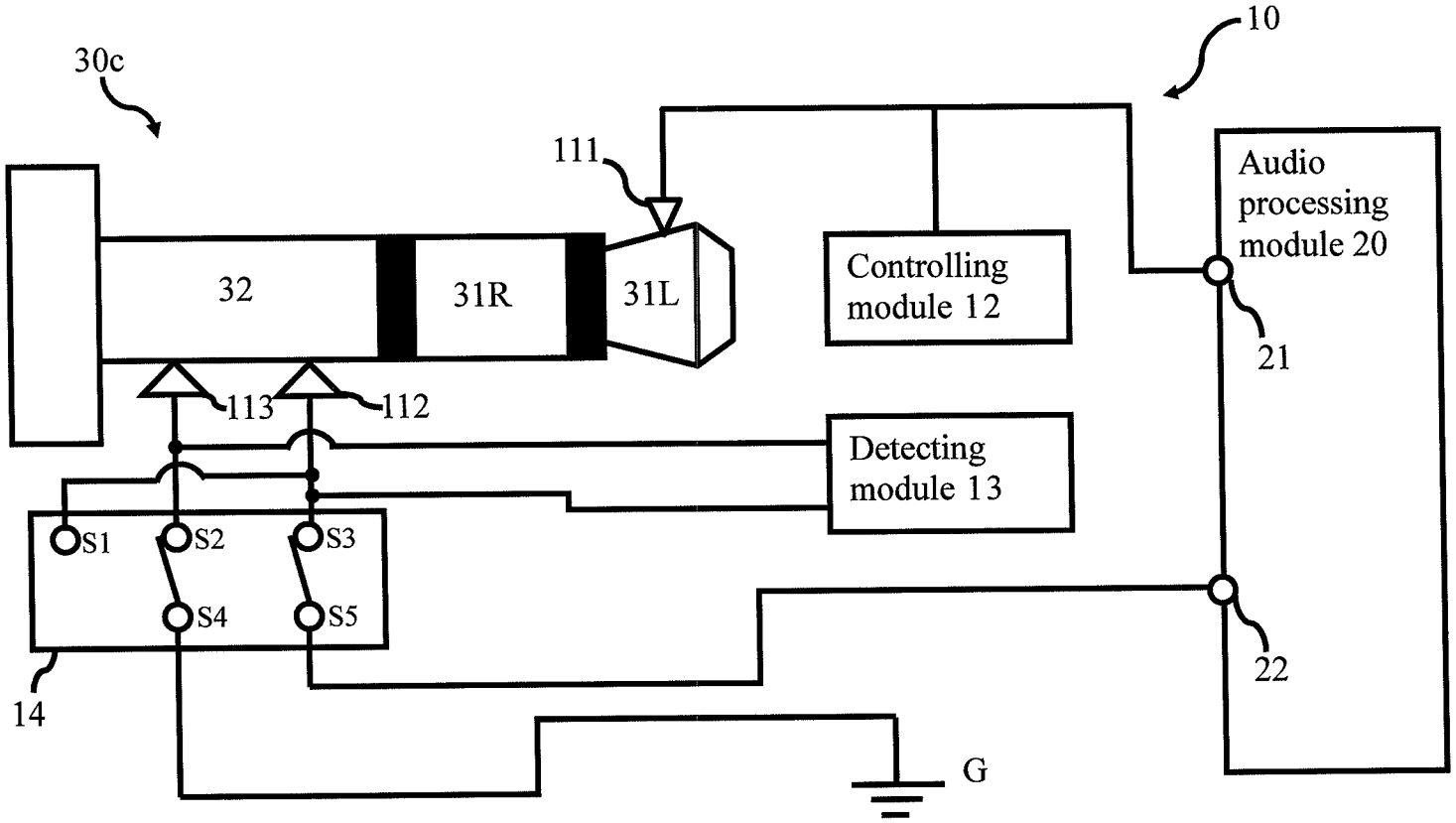
FIG. 4 illustrates a schematic drawing of a signal connecting module connected to a connector of the third embodiment of the present invention.

Please refer to FIG. 4, illustrates a schematic drawing of a signal connecting module connected to a connector of the third embodiment of the present invention.

In the third embodiment of the present invention, the detecting module 13 detects the current signal from both the second pin 112 and the third pin 113; therefore, the detecting module 13 determines that the connector 30*c* is the third type connector 30*c*, which means the sequence of the pin (from right to left) is the earphone pin 31 and the ground pin 32.

When the connecting port 11 connects the third type connector 30*c*, the switch module 14 switches the fourth contact S4 to the second contact S2, and switches the fifth contact S5 to the third contact S3, allowing the third pin 113 to be electrically connected to the grounding end G. On the other hand, the microphone signal end 22 which is electrically connected to the second pin 112 can be controlled to open circuit by the audio processing module 20.

Figure 5:
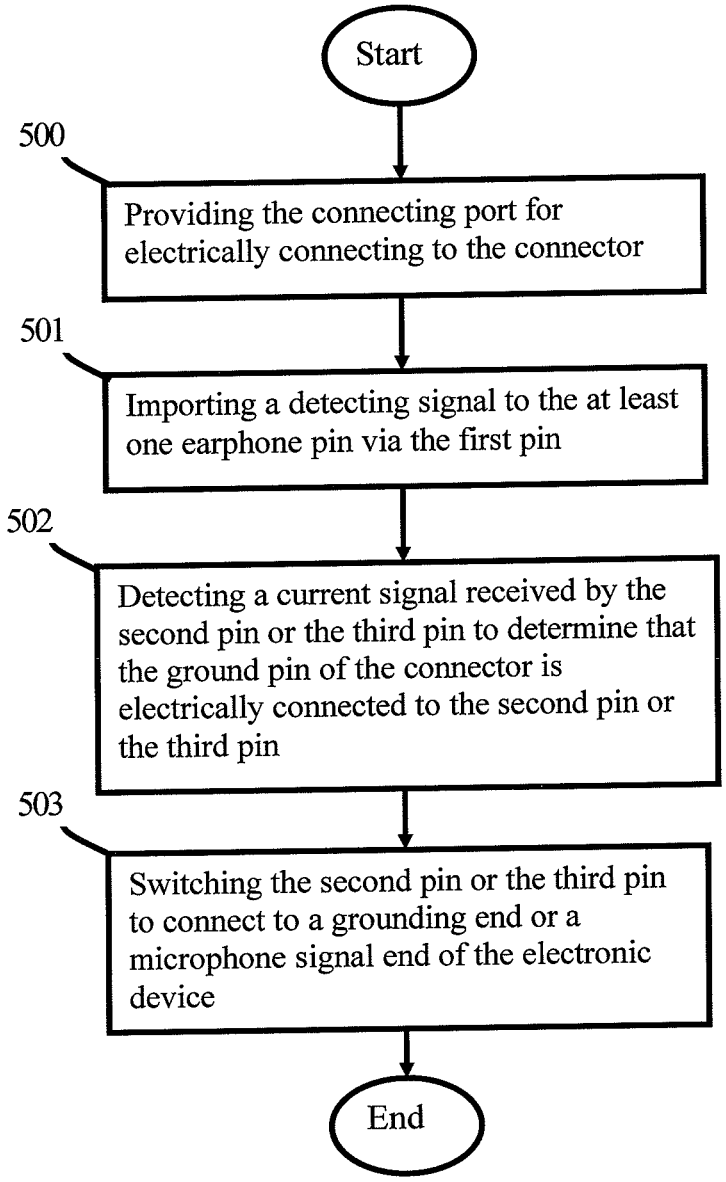
FIG. 5 illustrates a step flowchart of a connector identification method of the present invention.

Please refer to FIG. 5, which illustrates a step flowchart of a connector identification method of the present invention. It is to be understood that the electronic device 1 with the signal connecting module 10 is taken as an example for describing the connector identification method of the present invention, but the connector identification method of the present invention is not limited to be applied to the electronic device 1 with the signal connecting module 10.

The method starts at Step 500: providing the connecting port for electrically connecting to the connector.

First, the connecting port 11 of the electronic device 1 is connected to the connector 30, allowing the first pin 111, the second pin 112, and the third pin 113 to be respectively electrically connected to the earphone pin 31, the ground pin 32, and the microphone pin 33.

Then the method goes to Step 501: importing a detecting signal to the at least one earphone pin via the first pin.

When the controlling module 12 detects that the connecting port 11 is connected to the connector 30, the controlling module 12 imports the detecting signal to the earphone pin 31 via the first pin 111.

Then the method goes to Step 502: detecting a current signal received by the second pin or the third pin to determine that the ground pin of the connector is electrically connected to the second pin or the third pin.

The detecting module 13 detects the current signal received by the second pin 112 or the third pin 113 to determine that the ground pin 32 is electrically connected to the second pin 112 or the third pin 113. Therefore, the detecting module 13 can determine the type of the connector 30.

If the second pin 112 receives the current signal, the detecting module 13 determines that the first type connector 30*a* is plugged to the connecting port 11 (as shown in FIG. 2). If the third pin 113 received the current signal, the detecting module 13 determines that the second type connector 30*b* is plugged to the connecting port 11 (as shown in FIG. 3). If the second pin 112 and the third pin 113 receive the current signal in the meanwhile, the detecting module 13 determines that the third type connector 30*c* is plugged to the connecting port 11 (as shown in FIG. 4).

Finally the method goes to Step 503: switching the second pin or the third pin to connect to a grounding end or a microphone signal end of the electronic device.

Finally, according to the result of detecting at Step 502, the switch module 14 switches the second pin 112 or the third pin 113 to connect to the microphone signal end 22 or the grounding end G. If the first type connector 30*a* plugged to the connecting port 11, the switch module 14 switches the second pin 112 to electrically connect to the grounding end G, and switches the third pin 113 to electrically connect to the microphone signal end 22. If the second type connector 30*b* plugged to the connecting port 11, the switch module 14 switches the second pin 112 to electrically connect to the microphone signal end 22, and switches the third pin 113 to electrically connect to the grounding end G. If the third type connector 30*c* plugged to the connecting port 11, the switch module 14 switches the third pin 113 to electrically connect to the grounding end G, and the audio processing module 20 can control the microphone signal end 22 to open circuit.

It is to be understood that the step sequence of the connector identification method of the present invention is not limited to the abovementioned description; the step sequence can be changed if the object of the present invention is achieved. The abovementioned types of the connector 30 are only for illustration, the method of the present invention is not limited to the abovementioned types of connectors.

By the signal connecting module 10 and the connector identification method of the present invention, the electronic device 1 can automatically detect and be applied to the connectors 30 of different specs, instead of being applied to the connector 30 of single spec.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A signal connecting module applied to an electronic device for electrically connecting to a connector, the connector comprising at least one earphone pin and a ground pin, the signal connecting module comprising:

a connecting port for electrically connecting to the connector, the connecting port comprising:

a first pin electrically connected to the at least one earphone pin and an earphone signal end of the electronic device;

a second pin; and a third pin;

a controlling module electrically connected to the first pin; when the connecting port is connected to the connector, the controlling module outputs a detecting signal to the at least one earphone pin via the first pin;

a detecting module electrically connected to the second pin and the third pin; wherein after the controlling module outputs the detecting signal, the detecting module detects a current signal received by the second pin or the third pin to determine that the around pin of the connector is electrically connected to the second pin or the third pin; and a switch module connected to the second pin and the third pin, wherein the switch module switches the second pin or the third pin to electrically connect to a grounding end or a microphone signal end of the electronic device, wherein:

if the second pin receives the current signal, the detecting module determines that the connector is a first type connector, and the switch module switches the second pin to electrically connect to the grounding end, and switches the third pin to electrically connect to the microphone signal end.

2. The signal connecting module as claimed in claim 1, wherein: if the third pin receives the current signal, the detecting module determines that the connector is a second type connector, and the switch module switches the second pin to electrically connect to the microphone signal end, and switches the third pin to electrically connect to the grounding end.

3. The signal connecting module as claimed in claim 2, wherein: if the second pin and the third pin receive the current signal, the detecting module determines that the connector is a third type connector, and the switch module switches the third pin to electrically connect to the grounding end.

4. The signal connecting module as claimed in claim 1, wherein the switch module is a hardware-based switch, or to achieve a switching function via a software.

5. The signal connecting module as claimed in claim 1, wherein the controlling module and the detecting module are a microcontroller.

6. An electronic device comprising:

an audio processing module comprising an earphone signal end and a microphone signal end; and a signal connecting module electrically connected to the audio processing module for electrically connecting a connector, the connector comprises at least one earphone pin and a ground pin, the signal connecting module comprising:

a connecting port for electrically connecting the connector, the connecting port comprising:

a first pin electrically connected to the at least one earphone pin and the earphone signal end;

a second pin; and a third pin;

a controlling module electrically connected to the first pin; when the connecting port is connected to the connector, the controlling module outputs a detecting signal to the at least one earphone pin via the first pin;

a detecting module electrically connected to the second pin and the third pin; wherein after the controlling module outputs the detecting signal, the detecting module detects a current signal received by the second pin or the third pin to determine that the ground pin of the connector is electrically connected to the second pin or the third pin; and a switch module for switching the second pin or the third pin to connect to a microphone signal end or a grounding end, wherein:

if the second pin receives the current signal, the detecting module determines that the connector is a first type connector, and the switch module switches the second pin to electrically connect to the grounding end, and switches the third pin to electrically connect to the microphone signal end.

7. The electronic device as claimed in claim 6, wherein: if the third pin receives the current signal, the detecting module determines that the connector is a second type connector, and the switch module switches the second pin to electrically connect to the microphone signal end, and switches the third pin to electrically connect to the grounding end.

8. The electronic device as claimed in claim 7, wherein:

if the second pin and the third pin receive the current signal in the meanwhile, the detecting module determines that the connector is a third type connector, and the switch module switches the third pin to electrically connect to the grounding end.

9. The electronic device as claimed in claim 6, wherein the switch module is a hardware-based switch, or to achieve a switching function via a software.

10. The electronic device as claimed in claim 6, wherein the audio processing module, the controlling module and the detecting module are a microcontroller.

11. A connector identification method, applied to a connecting port of a signal connecting module in an electronic device for identifying a connector which is electrically connected, the connector comprises at least one earphone pin and a ground pin, the connecting port comprises a first pin, a second pin, and a third pin, the connector identification method comprises:

providing the connecting port for electrically connecting to the connector;

importing a detecting signal to the at least one earphone pin via the first pin;

detecting a current signal received by the second pin or the third pin to determine that the ground pin of the connector is electrically connected to the second pin or the third pin;

determining that the connector is a first type connector if the second pin receives the current signal; and switching the second pin to electrically connect to a grounding end, and switching the third pin to electrically connect to a microphone signal end if the connector is the first type connector.

12. The connector identification method as claimed in claim 11, further comprising:

determining that the connector is a second type connector if the third pin receives the current signal; and switching the second pin to electrically connect to the microphone signal end, and switching the third pin to electrically connect to the grounding end if the connector is the second type connector.

13. The connector identification method as claimed in claim 12, further comprising:

determining that the connector is a third type connector if the second pin and the third pin receive the current signal; and switching the third pin to electrically connect to the grounding end if the connector is the third type connector.

* * * * *